United States Patent [19]

King

[11] Patent Number: 4,919,397

[45] **Date of Patent: * Apr. 24, 1990**

[54] STATIONARY INJECTION BLOCK AND INJECTION SLIDE PLATE FOR USE WITH AN INJECTION VALVE

[75] Inventor: Patrick D. King, Rantoul, Ill.

[73] Assignee: Flo-Con Systems, Inc., Champaign, Ill.

[ * ] Notice: The portion of the term of this patent subsequent to Jan. 24, 2006 has been disclaimed.

[21] Appl. No.: 179,986

[22] Filed: Apr. 11, 1988

Related U.S. Application Data

[60] Division of Ser. No. 53,080, May 22, 1987, Pat. No. 4,771,992, which is a continuation-in-part of Ser. No. 14,999, Feb. 17, 1987, Pat. No. 4,799,649, which is a continuation-in-part of Ser. No. 885,873, Jul. 15, 1986, Pat. No. 4,824,079.

[51] Int. Cl.[5] ..... C21C 5/48

[52] U.S. Cl. ..... 266/267; 266/265; 266/287

[58] Field of Search ..... 266/47, 218, 265, 268, 266/270, 287, 224, 267; 222/600

[56] References Cited

U.S. PATENT DOCUMENTS

| | | | |
|---|---|---|---|
| 3,330,645 | 7/1967 | de Moustier et al. | 266/268 |
| 4,222,553 | 9/1980 | Edamoto | 266/47 |
| 4,508,324 | 4/1985 | Luhrsen et al. | 266/287 |
| 4,627,147 | 12/1986 | Kagi | 266/287 |
| 4,717,128 | 1/1988 | Bruckner et al. | 266/287 |
| 4,763,881 | 8/1988 | Wenger | 266/287 |
| 4,799,649 | 1/1989 | King | 266/270 |

FOREIGN PATENT DOCUMENTS

| | | | |
|---|---|---|---|
| 13015 | 1/1985 | Japan | 266/218 |

*Primary Examiner*—Robert McDowell
*Attorney, Agent, or Firm*—Jack E. Dominik

[57] ABSTRACT

A multiple orifice injection valve having a stationary block which communicates between the vessel and a sliding plate. The sliding plate is provided with at least one injection port and drive means for rotatably indexing the same in and out of register with the various orifices in the stationary block. Both the stationary block and sliding plate may have special wear features. The sliding plate is held by means of a carrier, and the same urged by a plurality of spring-loaded rockers into pressure face-to-face relationhip with the stationary block. The valve can be open by a toggle latch and toggle hinge assembly thereby permitting removal of the sliding plate and/or the stationary block. Injection is provided by a quick disconnect coupling having two injection ports. The one port receives wire or other metallic material in wire form, and the second port injects gas, powdered metals, or other fluid-like materials. The method contemplates the steps of providing a multiple orifice connection between the inside of the vessel and a shut-off plate, with the shut-off plate having a single orifice or more orifices for indexing in and out of position with the orifices in the stationary block. Also blocking plugs are provided in the stationary block which, according to the method, are forceably removed prior to the ladle metallurgical treatment applied.

11 Claims, 5 Drawing Sheets

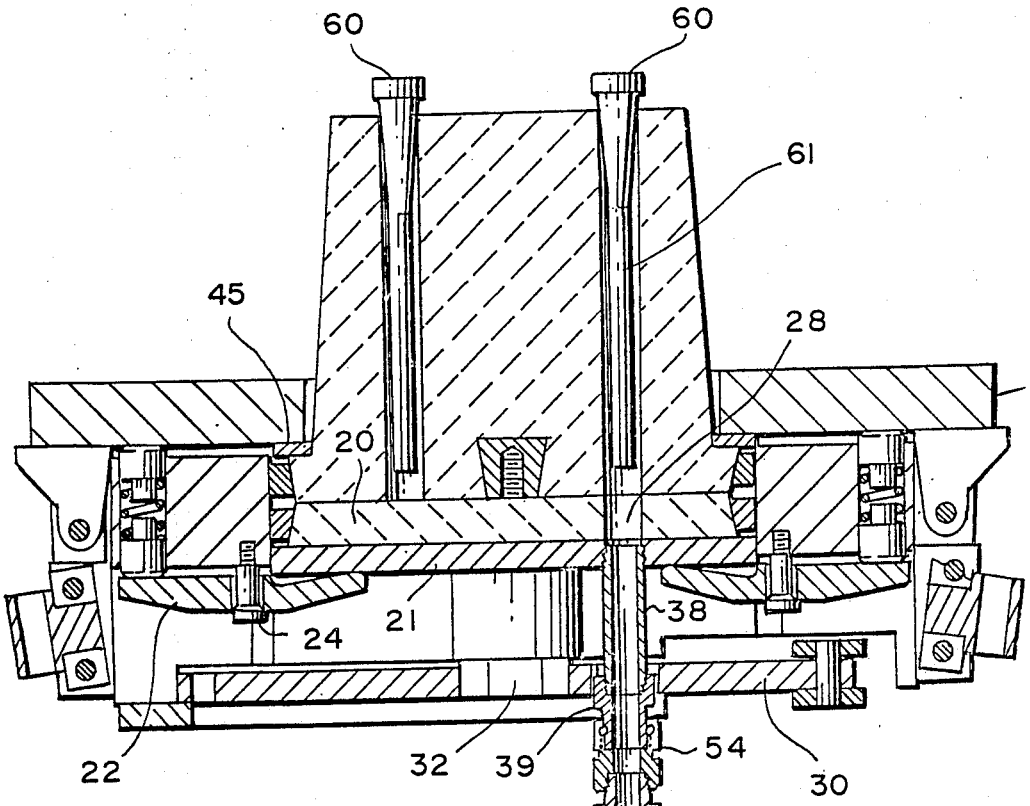
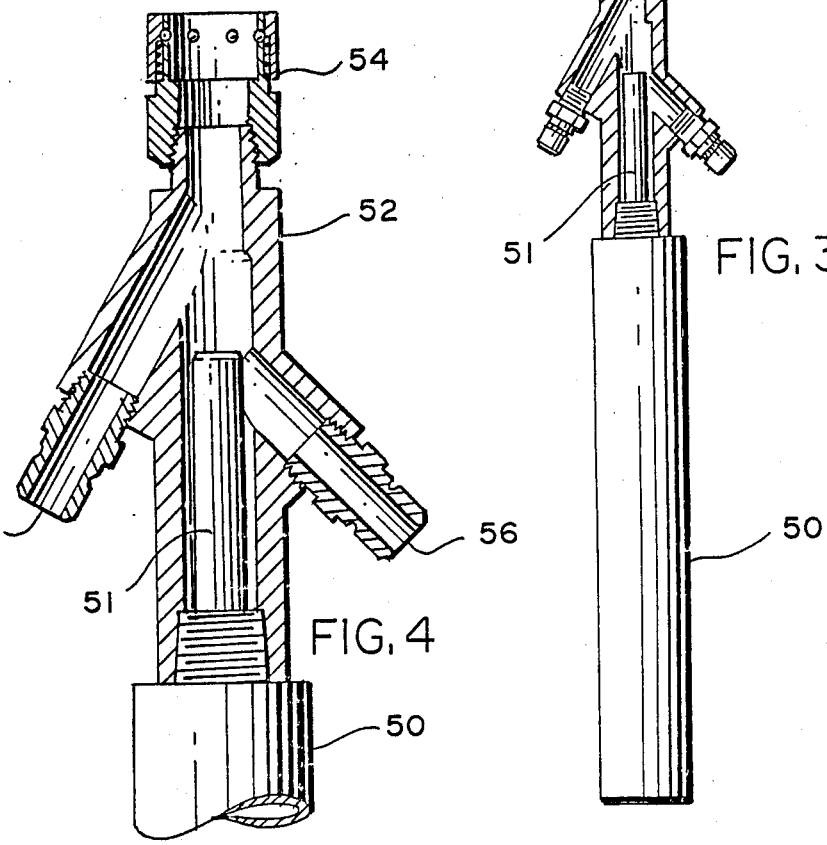
FIG. 4
FIG. 3

STATIONARY INJECTION BLOCK AND INJECTION SLIDE PLATE FOR USE WITH AN INJECTION VALVE

This application is a divisional of previously filed application Ser. No. 053,080 filed May 22, 1987, U.S. Pat. No. 4,771,992 entitled "MULTI-HOLE INJECTION VALVE AND METHOD", which is also a continuation-in-part of Ser. No. 014,999 filed Feb. 19, 1987, U.S. Pat. No. 4,799,649 and entitled "INJECTION VALVE COMPONENTS AND METHOD", which application is a continuation-in-part of Ser. No. 885,873 filed July 15, 1986 U.S. Pat. No. 4,824,079 and entitled "INJECTION VALVE COMPONENTS AND METHOD", by the same inventor herein.

BACKGROUND OF THE INVENTION

1. Field of the Invention

The present invention relates primarily to ladle metallurgy, and more specifically to an injection valve for use with a ladle, and the method of ladle metallurgy.

2. Summary of the Prior Art:

The prior art is exemplified in U.S. Pat. Nos. 3,997,148; 4,298,192; 4,423,858; 4,575,398; and 4,582,232. Various devices have been developed for injection into ladles, tundishes, or other holding vessels. Several are complex in nature, and most, because of a single injection capability, must be lanced or otherwise replaced after each injection.

SUMMARY OF THE INVENTION

The present invention is directed to a multiple orifice injection valve having a stationary block which communicates between the vessel and a sliding plate. The sliding plate is provided with at least one injection port and drive means for rotatably indexing the same in and out of register with the various orifices in the stationary block. Both the stationary block and sliding plate may have special wear features. The sliding plate is held by means of a carrier, and the same urged by a plurality of spring-loaded rockers into pressure face-to-face relationship with the stationary block. The valve can be open by a toggle latch and toggle hinge assembly thereby permitting removal of the sliding plate and/or the stationary block. Injection is provided by a quick disconnect coupling have two injection pots. The one port receives wire or other metallic material in wire form, and the second port injects gas, powered metals, or other fluid-like materials. The method contemplates the steps of providing a multiple orifice connection between the inside of the vessel and a shut-off plate, with the shut-off plate having a single orifice or more orifices for indexing in and out of position with the orifices in the stationary block. Also blocking plugs are provided in the stationary block which, according to the method, are forceably removed prior to the ladle metallurgical treatment applied.

In view of the foregoing it is a principle object of the present invention to provide a multiple orifice injection valve which permits injecting at various times during a heat, and shutting off the injection, and reactivating again for six total applications.

Another object of the present invention is to provide an injection valve which permits the simultaneous ladle treatment with a wire-type metal alloy, and also the injection of gas or powdered materials.

Still another object of the present invention is to provide a multiple orifice injection valve in which the two principle members, the stationary block and the slide gate, may be readily removed and replaced.

A more detailed object of the present invention is to provide an injection valve with a stationary block and sliding plate, one or both of which are elliptical in cross-section thereby permitting locking to related structures.

Yet another object of the present invention is to provide the stationary block with a wear plate and the sliding plate with a wear plug to upgrade the usage and life of the block plate sets.

BRIEF DESCRIPTION OF THE DRAWINGS

Further objects and advantages of the present invention will become apparent as the following description proceeds, taken in conjunction with the accompanying drawings, in which:

FIG. 3 is a somewhat smaller view of what is shown in FIG. 2, but showing in extended form the punch-out cylinder and multiple media injection connector;

FIG. 4 is a further sectional view in enlarged form of the multiple media injection assembly;

DETAILED DESCRIPTION OF A PREFERRED EMBODIMENT

Figures 1, 2:
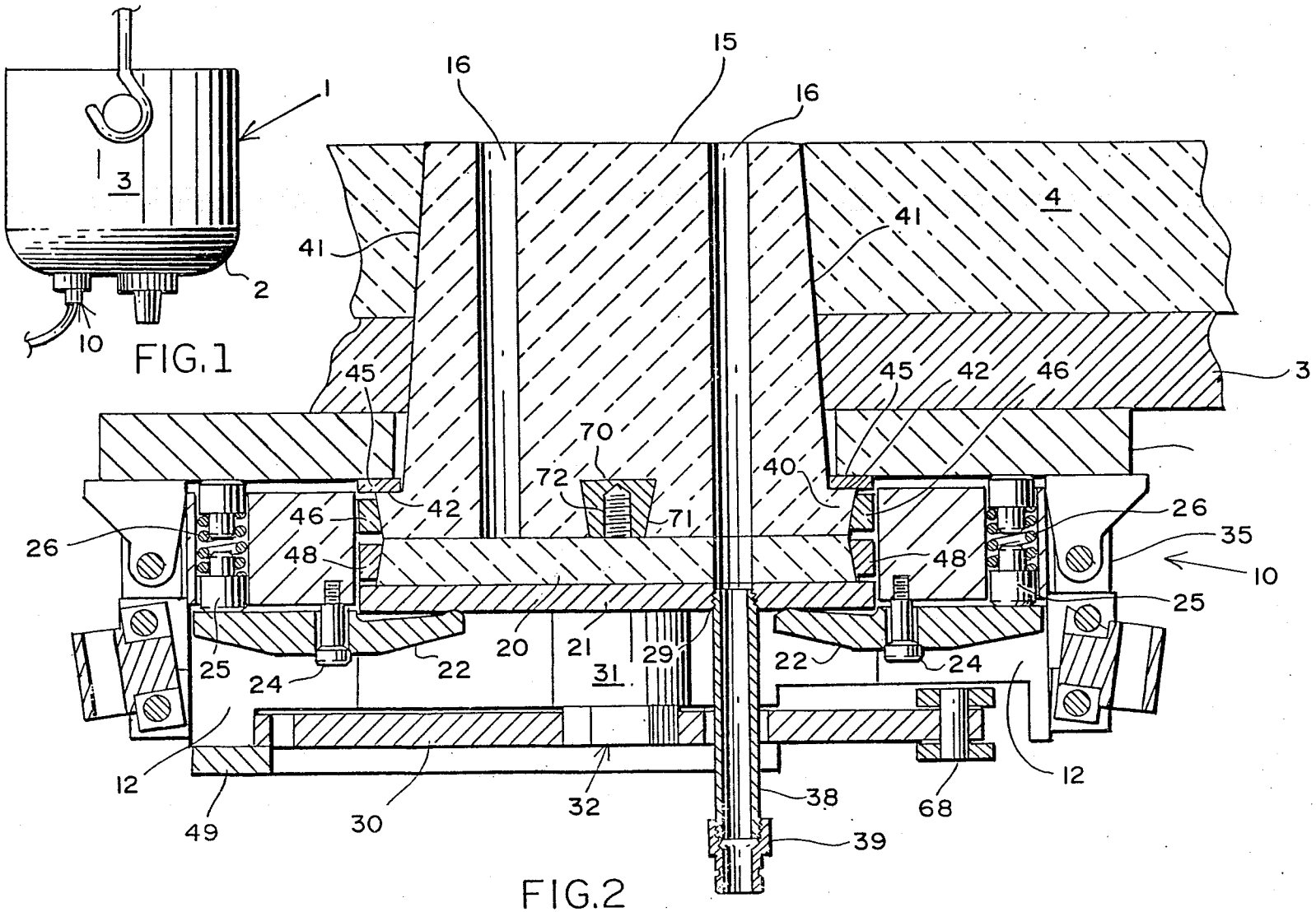
FIG. 1 is a partially diagrammatic view of a ladle or vessel showing a sliding gate valve at its lower portion and the utilization of an injection valve also adjacent the slide gate on the lower portion.
FIG. 2 is an enlarged transverse sectional view of the injection valve showing its mounted relationship with the ladle or vessel.

Referring now to the drawings, FIG. 1 illustrates the utilization of a ladle 1 having a typical slide gate 2 mounted at its lower portion. An injection valve 10 is illustrated diagrammatically at a lower portion of the ladle 1. Here it should be understood that an injection valve 10 may also be applied to a tundish, or other vessel for the holding of metals in anticipation of teeming, and after being withdrawn from the furnace. Most such vessels are provided with independent heating elements in order to maintain the contained metal in a molten condition.

As shown in FIG. 2, the injection valve 10 is mounted to the vessel or ladle 1 by being secured to the ladle wall 3, and penetrating the ladle refractory liner 4 through an opening 5. A mounting plate 11 is provided at the upper portion of the injection valve 10 to be bolted or otherwise secured to the ladle wall 3. A main frame 12 extends downwardly from the mounting plate 11 and holds the various elements in the injection valve 10.

Figure 9:
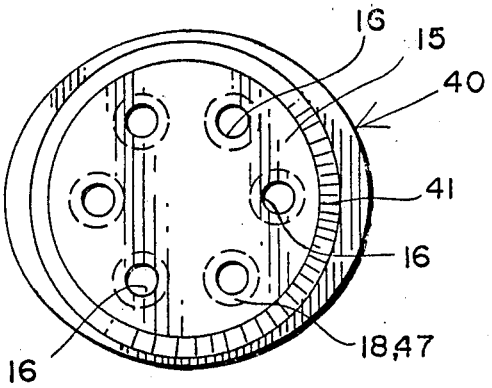
FIG. 9 is a top view of the stationary block illustrating the orientation of the orifices, and the nature of the elliptical construction.
Figure 10:
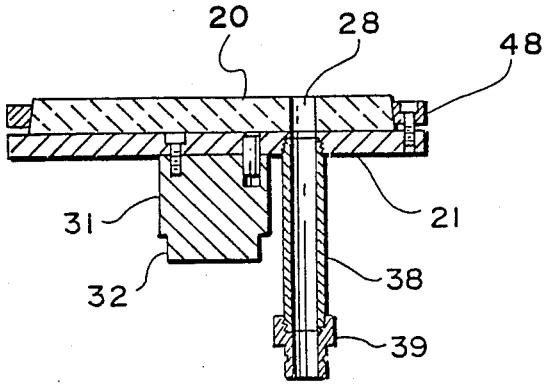
FIG. 10 is an enlarged view of the drive hub which, in its assembled relationship, connects the drive plate operatively with the sliding plate carrier.

Central to the construction of the injection valve is the stationary block 15 which is positioned within the opening 5. The face of the stationary injection block 15 may be elliptical in horizontal cross-section to secure the same against rotation inside the opening 5. To this end the opening 5 is complementarily elliptical to receive and lockingly engage the stationary block 15. Central of the stationary block are a plurality of stationary block orifices 16. As shown in FIG. 9, these orifices 16 are essentially oriented on a circle surrounding the geometrical center of the stationary block 15.

Also central to the injection valve is a rotating injection slide plate 20 mounted on top of a slide plate carrier 21. The rotating slide plate 20 is preferably elliptical in configuration with means for mounting the same to the slide plate carrier 21 which will be described hereinafter.

Figure 7:
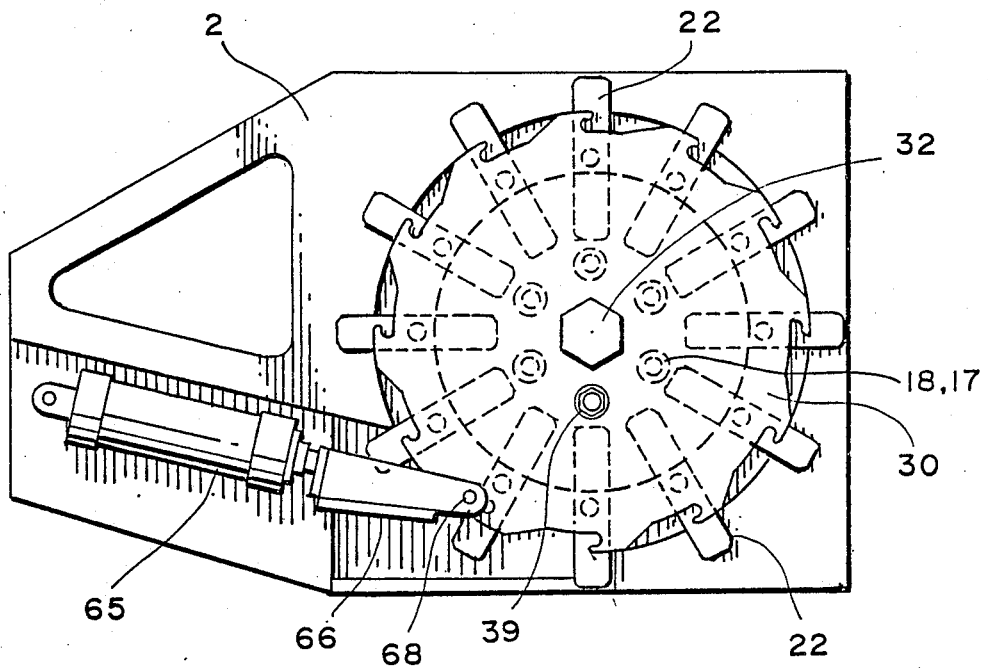
FIG. 7 is a bottom view of the injection valve showing in phantom lines the location of the rocker assemblies which hold the sliding plate in pressure relationship with the stationary block.

In order to maintain the rotary slide plate in pressure face-to-face relationship with the lower end portion of the stationary block 15, a plurality of rocker arms 22 are provided to yieldably engage the slide plate carrier 21. The rocker arm 22, particularly as shown in phantom lines in FIG. 7, are oriented radially around the slide plate carrier 21. Again as shown in FIG. 2, each rocker arm 20 is pivotally secured by a rocker arm bolt 24. One end of the rocker arm is engaged by a spring pad 25 which, in turn, is urged downwardly by spring 26 to thereby pivot the rocker arm 22 and urge its opposite end to press against the slide plate carrier 21.

The slide injection plate 20 is provided desirably with at least one orifice 28. A carrier pipe connector 29 is secured to the slide plate carrier 21 in an orifice designed for orientation immediately beneath the slide plate orifice 28. Additional orifices 28 and inlet pipes 29 may be mounted on the sliding injection plate 20.

The entire mechanism is driven by a drive plate 30, which coacts through a drive hub 31 having a hex head 32 secured in the drive plate 30. The hub 31 connects directly to the lower portion of the slide plate carrier 21 and is secured in driving engagement therewith by pin 33 and bolt 34.

The main frame 12 of the injection valve 10 has a latch toggle 35, and an opposed hinge toggle 36. By releasing the latch toggle and hinging the frame the interior can be opened up for servicing the stationary block 15, the rotary slide plate 20, and other elements of the construction.

Turning now to FIG. 3, it will be seen in greater detail that the inlet pipe 38 which connects between the drive plate 30 and the slide plate carrier 21 includes an inlet coupling 39.

Figure 8:
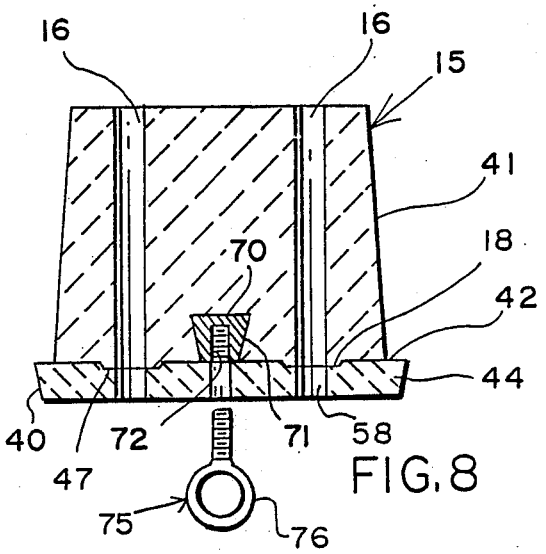
FIG. 8 is an enlarged transverse sectional view of the stationary block and showing an optional wear plate and the puller assembly.

As noted in FIG. 8, the stationary injection block 15 includes a stationary injection block collar 40 which is preferably elliptical, a stationary injection block sidewall 141, which is frustoconical, and a stationary injection block collar shoulder 42. The stationary block shoulder 42 is engaged, as shown in FIG. 2, by a backing ring 45. A clamping ring 46 is provided for the stationary block collar 40, and is elliptical and complementary to the elliptical stationary injection block collar 40. It thereby permits securing the stationary injection block 15 against the backing ring 45 which, in turn, engages the mounting plate 11. A similar clamp ring 48 is provided for the rotary sliding plate 20. It is also similarly secured to the rotary slide plate carrier 21. The drive plate retainer 49 as shown in FIG. 2 secures the drive plate to the frame 11.

Noting now in FIG. 3, when it is time to begin ladle metallurgy, the punch-out cylinder 50 is activated and its punch-out rod 51 extends upwardly through the multi-media connector body 52. The multi-media connector body 52 has a multi-media connection 54, and a wire port 55. The wire port 55 is upstream from the multi-media port 56 so that any wire injected is unrestricted and uninhibited by the interior elements contained in the multi-media connector body 52. Such multi-media may include substances fed or suspended by fluids, such as gas or liquies. The purpose of the punch-out rod 51 is to engage the orifice plug 60 and more particularly its orifice plug shaft 61 to open the communication between the injection and the interior portion of the ladle 1.

Figure 5:
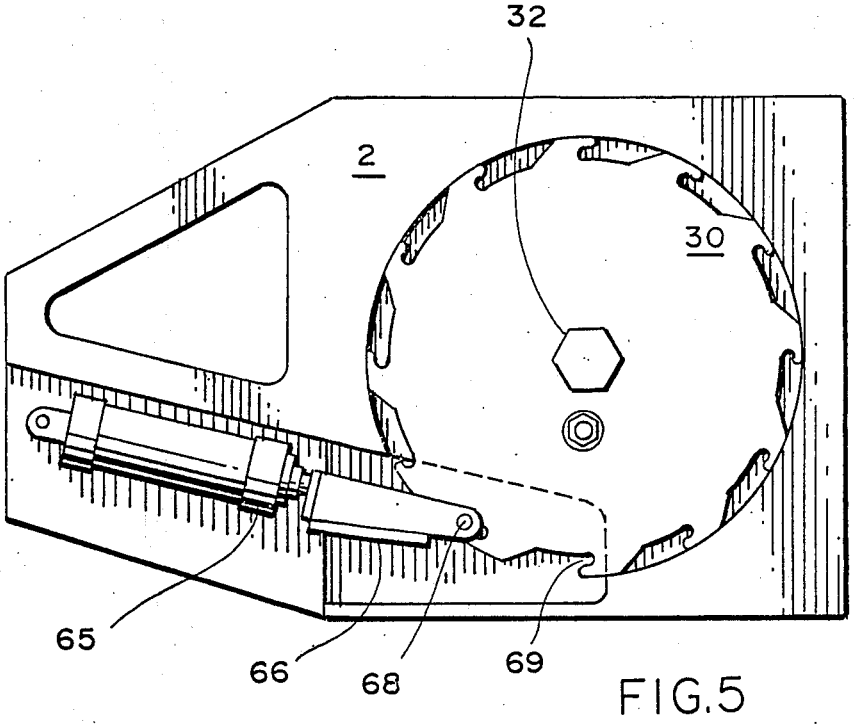
FIG. 5 is a bottom view of the injection valve showing the drive cylinder for indexing in its retracted position.
Figure 6:
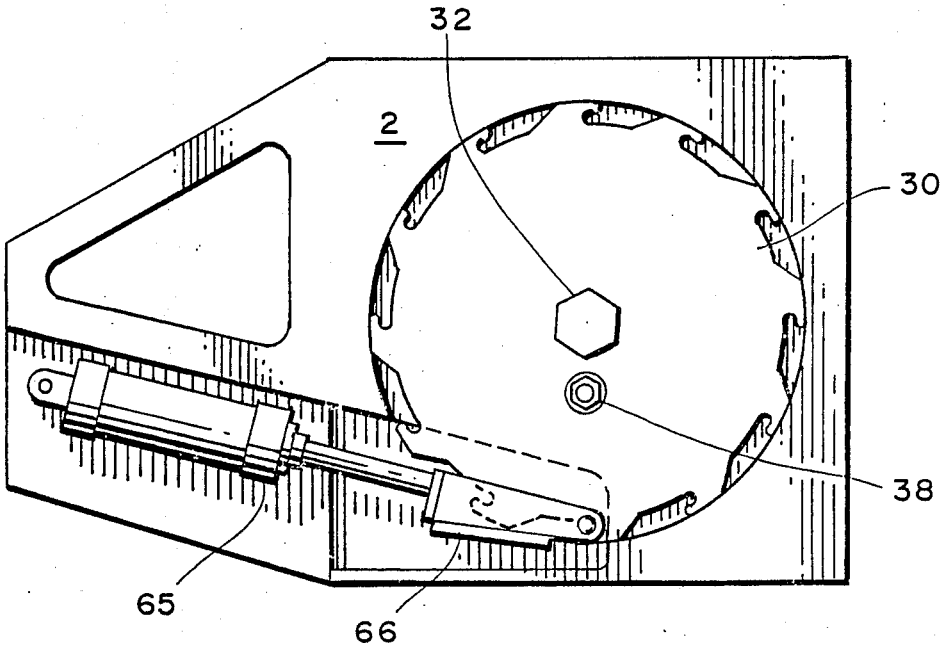
FIG. 6 is a sequential view of that shown in FIG. 5 with the drive cylinder in its extended position, having indexed from the configuration shown in FIG. 5.

Shown now in FIGS. 5 and 6 are the specifics of the drive plate 30. There it will be seen that a drive cylinder 65 operates a drive clevis 66. The drive clevis 66, in turn, contains the drive pin 68 which engages the drive notch 69 of the drive plate 30. Engagement is in indexing form, and the notches 69 are twice the number of orifices 16 in the stationary block 15. This permits each index to either shut off the orifice, or to align the orifices for injection.

After injection has been completed and the assembly is opened, the stationary block 15 can be removed by engaging its puller 70 shown in the lower portion of FIG. 8, and also in the lower central portion of FIG. 2. The puller 70 has a tapered frustoconical wall 71 which jammingly embeds the same at the central portion of the stationary injection block 15. Central to the puller 70 is a puller threaded bore 72. This is engaged by a threaded puller 75 having an eye or hook 76 as shown in exploded relationship in FIG. 8. This permits pulling the stationary block 15 out of the ladle opening 5 for replacement, or otherwise servicing the same.

To be noted in FIG. 8 is the combination with the stationary injection block 15 of an optional wear plate 44. The wear plate 44 is provided with recesses 47. The wear plate recesses 47 which surround each of the wear plate orifices 58. Oppositely stationary injection block bosses 18 are positioned at the interface between the stationary block and the wear plate 44 in surrounding relationship to the stationary block orifices 16. In this fashion, once the stationary block 15 is inserted in position, the elliptical wear plate is locked normally with the clamp ring 46. The offsetting locking relationship between the opposed block orifice bosses and wear plate orifice recesses insure a non-rotatable relationship between the block 15 and the wear plate 44.

Figure 11:
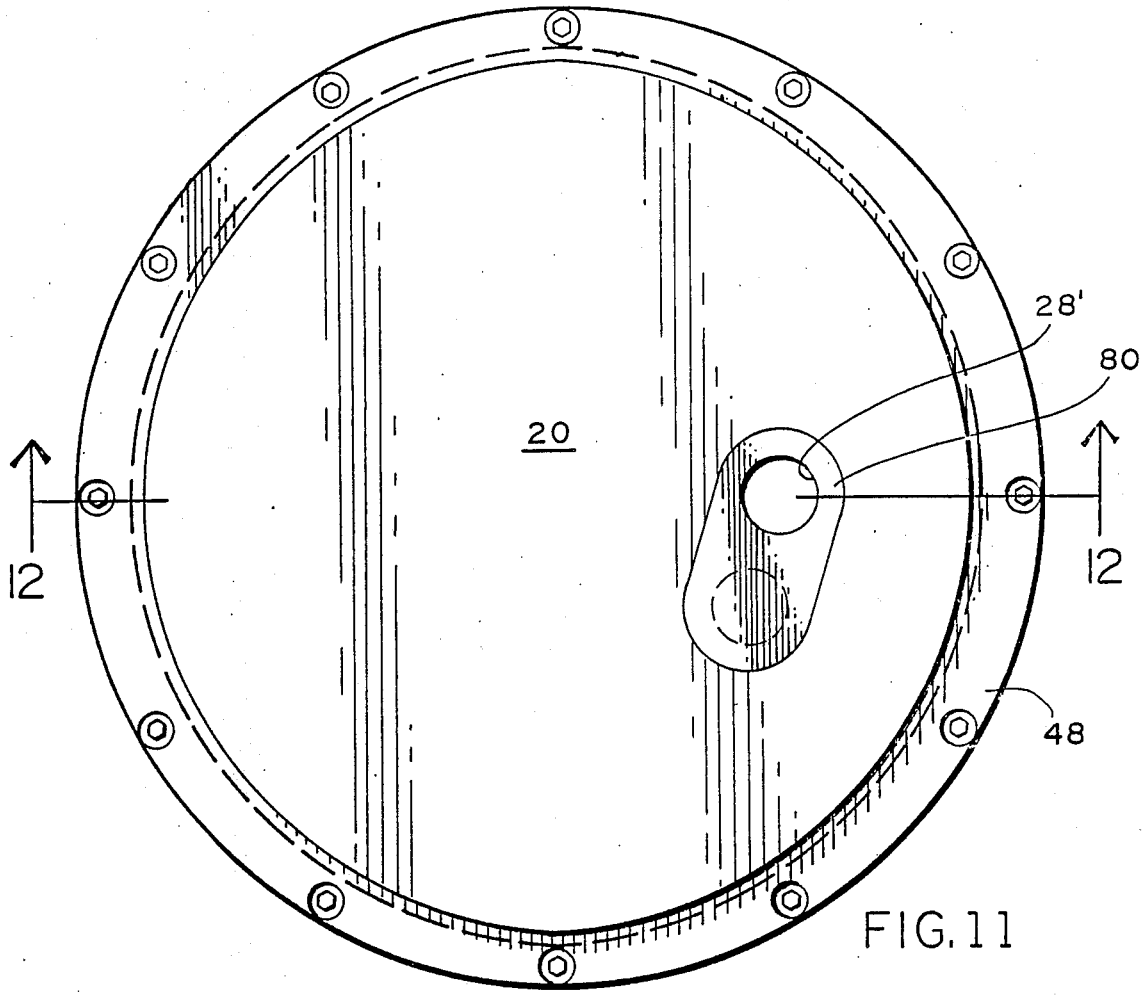
FIG. 11 is a plan view of an alternatve embodiment sliding plate having a wear insert.

As shown in FIG. 11, the rotating injection plate 20 is optionally supplied with a release insert 80 inserted in a complementary recess inside the plate 20. The orifice 28' is identical with the orifice where an insert 80 is not employed. Critical to the configuration of the insert 80, however, is its somewhat round configuration with the end opposed to the orfice 28' being positioned such a distance on the plate 20 that it will overlap an adjacent stationary block orifice 16.

Figure 12:
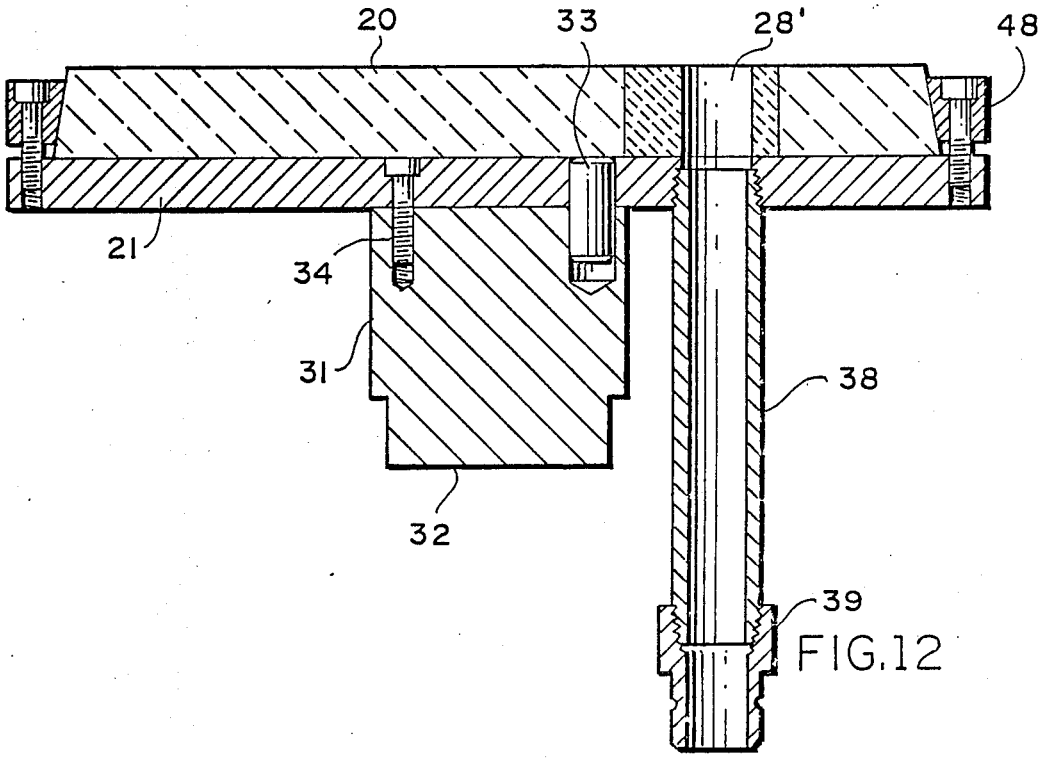
FIG. 12 is a transverse sectional view taken along section line 12—12 of FIG. 11.

In FIG. 12 the relationship between the rotating injection slide plate 20 and its slide plate carrier 21 is clearly shown. Also it will be noted that the drive hub 31 is secured to the slide plate carrier 21 by means of a pin 33, and secured against rotation by the bolt 34.

While materials do not necessarily form a limitation of the present invention, the release insert 80 employed in the rotating injection slide plate 20 should be of such a material as to form a smooth low permeability shut-off surface for metal to freeze in the bores of the stationary injection block. Once the metal freezes against the smooth low permeability surface, it does not have a tendency to attack the rest of the plate since the end of the frozen-off metal which may remain in the stationary block orifice 16 will be flushed off and flush with the balance of the refractory material in the rotating injection slide plate 20.

The method of the present invention contemplates metallurgy by steps taken in metal refining vessels. The first step is to connect a gas or powdered injection member along with a wire injection member so that additives can be introduced at the same time gas is employed, stir the bath, assist in metallurgy and to prevent a reverse flow of the metal. When shifting from one additive to another, the method contemplates a plurality of injection communications between the interior of the vessel and the injection apparatus. This permits sequential or simultaneous adding of various types of fluids, powders, and metals. Indeed, the same metal and gas can be added after a time delay by indexing to the next injection position. Sometimes staggered injection proves highly desirable and permits a greater homogeneity of the metallurgically treated contents of the vessel. It is important that indexing accomplish complete shut off in one position, and open communication in another position. Because a plurality of injection ports connect the vessel with the injection apparatus, lancing is not necessarily required after an orifice is frozen off with contained metal. Nonetheless provision may be made in order to lance an empty vessel by providing a second orifice in the sliding plate carrier with a lancing head.

Although particular embodiments of the invention have been shown and described in full here, there is no intention to thereby limit the invention to the details of such embodiments. On the contrary, the invention is to cover all modifications, alternatives, embodiments, usages and equivalents as fall within the spirit and scope of the present invention, specification, and appended claims.

What is claimed is:

1. A stationary injection block for an injection valve wherein by:

a sliding gate face at one end, a vessel face at the opposite end, a plurality of orifices through the block and substantially perpendicular to the faces, an elliptical cross section, said sidewall tapering in narrowing fashion toward the vessel face.

2. In the stationary injection block of claim 1, a collar at the periphery the sliding gate face, said collar tapering in enlarging fashion away from the sliding gate face, whereby a clamping ring proportional to mate with the collar can secure the plate within a vessel opening.

3. In the stationary injection block of claim 2, said collar being at the periphery of a separate wear plate, and means for securing the wear plate in nonrotatable engagement with the block.

4. In the stationary injection block of claim 3, said means for rotationally securing being boss and recess means in said plate and block secured in opposing nested relationship.

5. In the stationary injection block of any one of claims 1, 2, 3, or 4, a puller comprising a jammingly embedded threaded bore located centrally of the orifices and at the sliding gate face which can be engaged by a threaded puller to permit pulling the stationary block out of the ladle opening.

6. A sliding injection plate gate for an injection valve, having an injection block plate face, a carrier face, said faces being substantially parallel, said plate having a continuous curvilinear periphery, said periphery having means for mounting to a carrier, said periphery tapering in enlarging fashion away from the injection block face, said plate being elliptically shaped and an injection orifice spaced from the center of the sliding injection gate, said faces being substantially uninterrupted except for said injection orifice and said continuous curvilinear periphery being also essentially uninterrupted.

7. In the sliding injection plate gate of claim 6, said periphery having a noncircular configuration.

8. In the sliding injection plate gate of claim 6, said periphery being elliptical.

9. In the sliding injection plate gate of claim 6, said orifice being at a mid-position between the geometrical center and the periphery.

10. In the sliding injection gate of claim 6 a plurality of injection orifices uniformly spaced from the geometrical center of the plate.

11. In the sliding injection plate gate of any one of claims 6, 7, 8, 9, or 10 a release plug containing the injection orifice, said plug being mounted in the plate in a plug recess, said plug being long enough to cover the space between two adjacent injection orifices in an injection valve, the material for said plug being erosion and metal freeze resistant.

* * * * *